US005906006A

United States Patent [19]

Castro, Jr.

[11] Patent Number: 5,906,006

[45] Date of Patent: May 25, 1999

[54] ADJUSTABLE BANDANA-TYPE HEADWEAR

[76] Inventor: Felix Castro, Jr., 611 Menomonee Ave., South Milwaukee, Wis. 53172

[21] Appl. No.: 09/096,219

[22] Filed: Jun. 11, 1998

[51] Int. Cl.[6] ..... A42B 1/22

[52] U.S. Cl. ..... 2/207; 2/171; 2/183

[58] Field of Search ..... 2/171, 183, 195.2, 2/207, 172, 174

[56] References Cited

U.S. PATENT DOCUMENTS

| | | | |
|---|---|---|---|
| 2,519,512 | 8/1950 | Stone | 2/207 |
| 3,105,970 | 10/1963 | Herzberg | 2/207 |
| 4,486,903 | 12/1984 | Krystal | 2/195.2 |
| 4,654,897 | 4/1987 | Rosalen | 2/207 |
| 5,161,260 | 11/1992 | Reynolds | 2/207 |
| 5,608,914 | 3/1997 | Keesler | 2/207 |

*Primary Examiner*—Diana L. Biefeld
*Attorney, Agent, or Firm*—Ryan Kromholz & Manion

[57] ABSTRACT

A bandana-type headwear suitable for wearing under a helmet or as a independent head piece is disclosed. The headwear is preferably of a generally polygonal shape and has attached thereto adjustment straps of the peg and hole type generally used for adjustable caps. These straps are attached to the headwear fabric at an angle oblique to the central axis of the headwear to assist in installing and retaining the headwear on wearer's head.

3 Claims, 3 Drawing Sheets

ADJUSTABLE BANDANA-TYPE HEADWEAR

This invention relates headwear. More particularly, the invention relates to a bandana-type headwear used either as an independent head piece or under other headgear such as a helmet, the headwear being adjustable and easy to place over the wearer's head.

BACKGROUND OF THE INVENTION

Bandanas or bandana-like headgear have been used in the past in many contexts. Most recently such bandanas are worn for purposes of comfort, protection from the elements, and perspiration control under other headgear such as helmets. In some cases the helmets are used for protection of vehicle riders such as in the case of motorcycle or snowmobile riders. Many athletes such as football players have also adopted the use of such additional headgear beneath their protective helmets. Often such bandanas are provided in a color and with a design symbolizing a particular team, equipment brand, or group.

Traditionally such bandanas are attached by use of knots, pins or rubber bands etc. at the rear of the wearer's head. Disassembly of the headwear each time it is removed is thus a common requirement. It has also been proposed to attach such bandanas utilizing Velcro® hook and loop type fasteners. The latter, however, suffers from the possibility that the wearer's hair can be snagged by the Velcro®, causing pain and discomfort.

SUMMARY OF THE INVENTION

The present invention provides a novel combination of fabric headwear which is integral with a pair of adjustable interlocking straps of the type heretofore used with caps, and commonly referred to as "back straps". A related aspect of the invention is to provide bandana-type headwear having a shape adapted for ease of use in combination with the adjustable straps. Further aspects of the invention relate to the attachment of the adjustment straps to the headwear material at an oblique angle, which aids in proper fit and comfort during application and use of the headwear.

In accordance with a further aspect of the invention the headwear is readily placed over a wearer's head using the integral adjustable straps, and a rubber O-Ring or similar elastic band is used to secure any surplus headwear fabric behind the wearer's head. In accordance with a further related aspect the headwear of this invention has a generally polygonal, preferably pentagonal, shape rather than a conventional rectangular shape.

Further objects and advantages of the invention will be apparent from the appended claims, the detailed description and accompanying drawings.

DETAILED DESCRIPTION OF THE INVENTION

Figure 1:
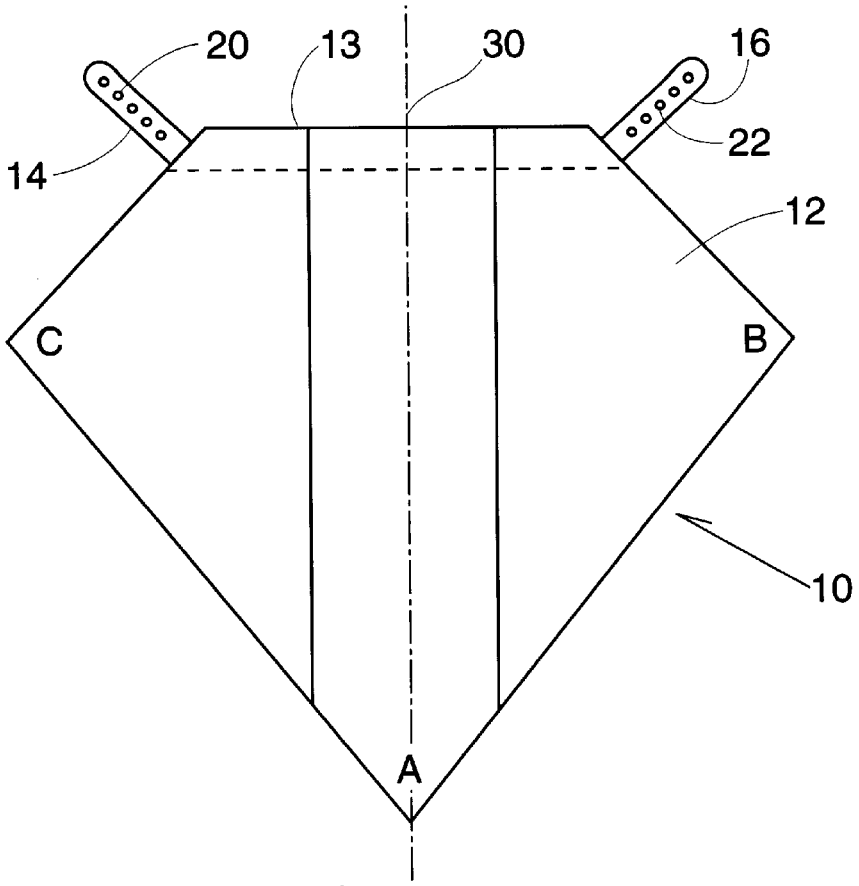
FIG. 1 is a top plan view of a bandana-type headwear piece of this invention.
Figure 2:
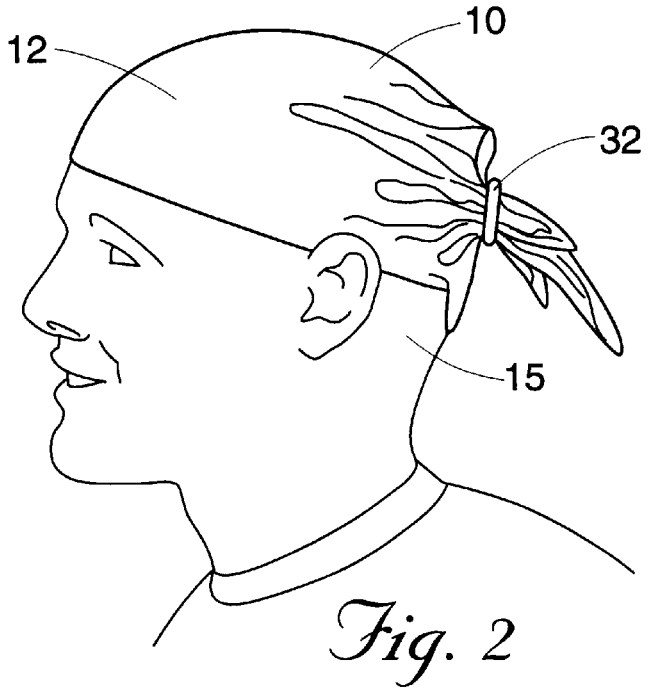
FIG. 2 is a perspective view showing headwear of this invention in place over a wearer's head.

Referring more particularly to the drawings there is seen in FIG. 1 headwear generally identified by numeral 10. Headwear 10 is formed of a generally pentagonal fabric body 12 to which are attached a pair of interlocking straps 14 and 16. One of the straps 14 is provided with a series of equally spaced apart apertures 20. The cooperating strap 16 is provided with a series of prongs or protrusions 22 having a spacing between them equal to that of the series of apertures 20. Preferably each protrusion 22 has a knob 24 or similar enlargement on its free end so that it will be retained in place when inserted into one of the holes 20.

As further best seen in FIG. 1, each of the straps 14 and 16 is secured to the forward edge 13 of edge of the headwear fabric 12 at an angle which is oblique and forwardly angled relative to the central longitudinal axis 30 of the headwear fabric. Such an oblique angle of attachment enhances the ability to secure the rear of the headwear beneath the base of the wearer's skull at the nape of his neck. The headwear is thus comfortable to wear and held firmly in place to avoid coming off in the wind, even if worn without a helmet, for example, on a motorcycle.

When the headwear is placed over the wearer's head it will be readily apparent that several folds of material will extend rearwardly. To hold this cluster of free ends in place behind the wearer's head it is preferred that a rubber O-Ring 32 or small rubber band, etc., be utilized to retain the surplus fabric in place.

It will be readily apparent that fabric 12 can be formed in a desired color or combination of colors selected by the wearer. A team logo, motorcycle or other commercial brand name or similar desired emblem can be affixed to the front of the headwear by stitching, adhesives, embossing or printing, as desired. It will thus be appreciated that the invention provides headwear that is readily adjustable, quick and easy to install and comfortable in use has been provided.

Headwear of this invention also has the advantage that the headpieces will stay securely in place until removed by the wearer. The attachment straps can also be readjusted at any time the wearer desires.

In practice the fabric body 12 of the headwear is formed out of a convenient fabric, usually cotton. The adjustment straps 14 and 16 are conveniently made out of a flexible plastic material such as polyethylene or polypropylene. However, any similar plastic or rubber material can be substituted if desired.

Figure 3:
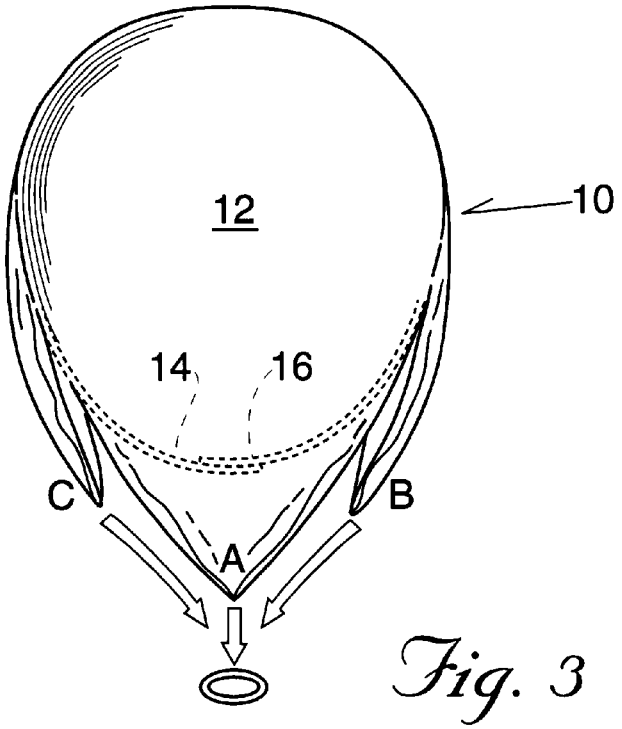
FIG. 3 is a top view illustrating assembly of the headwear of this invention, with interior parts shown by phantom lines.
Figure 4:
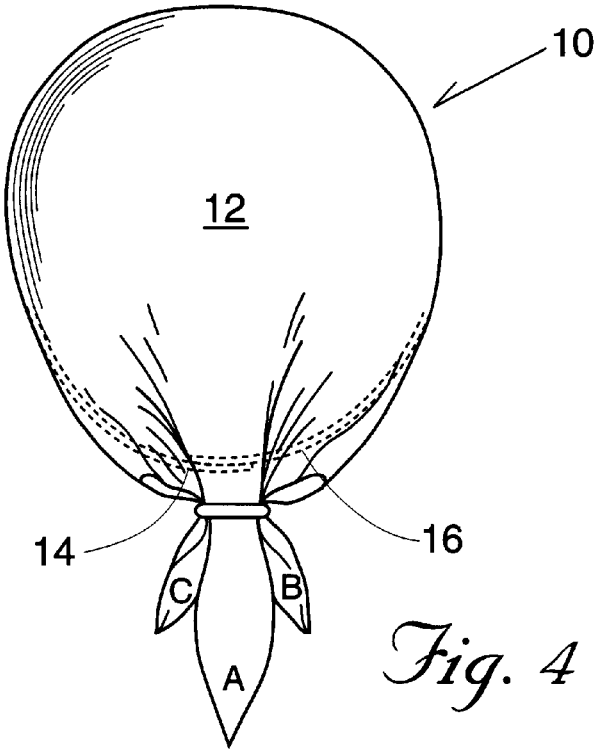
FIG. 4 is a top view of the headwear of this invention after assembly, also showing interior parts by phantom lines.
Figure 5:
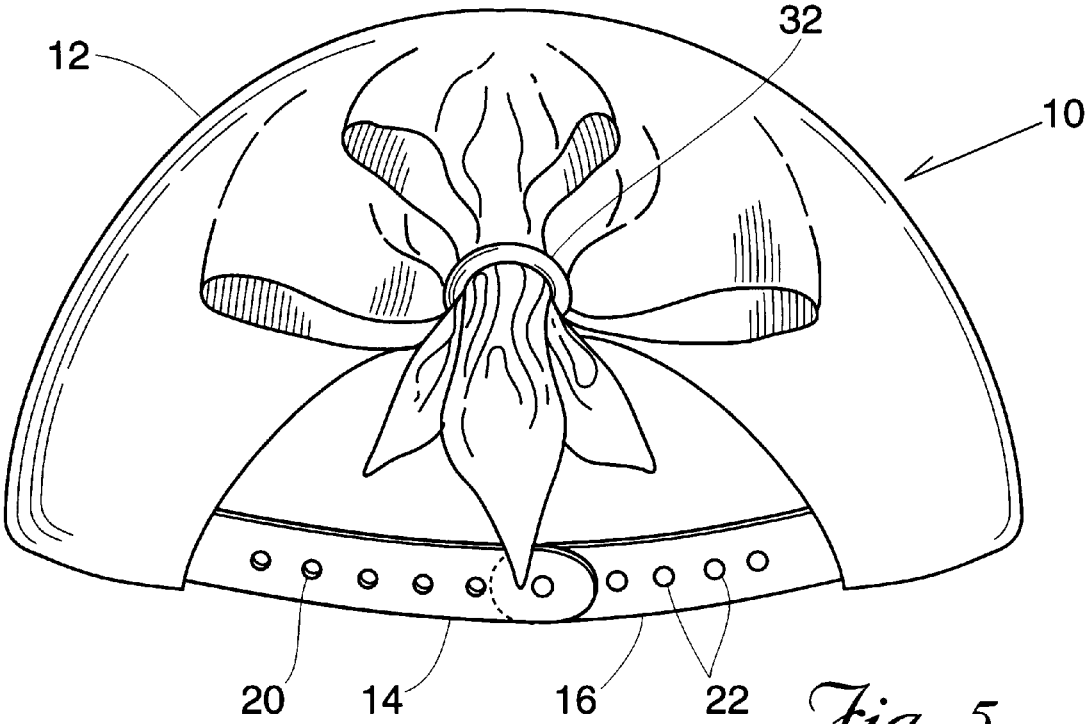
FIG. 5 is a rear view of the headwear of FIG. 4.
Figure 6:
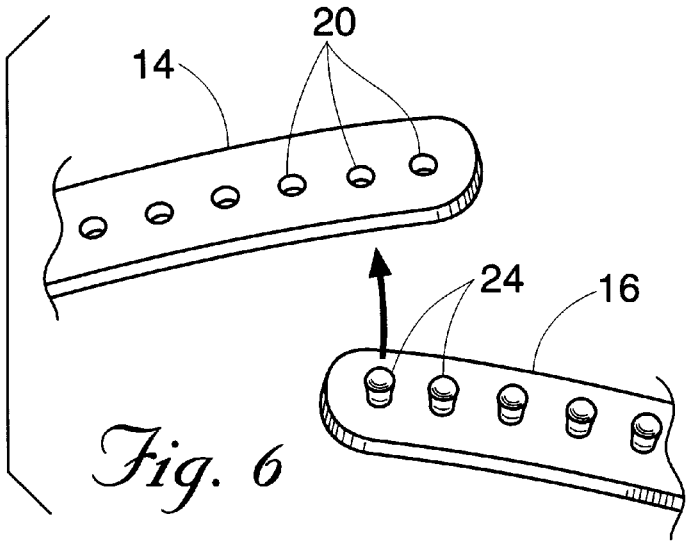
FIG. 6 is a fragmentary view showing, in enlarged scale, back straps used in connection with the invention.

In FIG. 1 the rearward edge of fabric body 12 is provided with reference letters A, B and C at its extremity corners. These corners are also referenced in FIGS. 3–5 which define the rearward surfaces of the fabric body 12 to illustrate the manner in which these corners become folded together and retained within ring 32 as the headwear 10 is placed on the head of wearer 15. Straps 14 and 16 are adjusted for proper fit and interlocked in known fashion when the headwear is put on by the wearer. It will also be apparent that the headwear 10 need not be disassembled when removed from the wearer's head 15. Instead, the straps 14 and 16 can simply be disconnected from each other. The rearward corners A, B and C can remain within ring 32, and the headwear 10 reinstalled on the wearer's head 15 by simple replacement and reattachment of straps 14 and 16 to each other.

In addition to the specific generally pentagonal shape shown in FIG. 1, various modifications of the general shape of the headwear can be made without departing from the spirit of the invention. Various other modifications will also be apparent to those skilled in art. The invention is thus not to be considered to be limited by the specific example shown which are illustrative of the concepts of this invention. The true scope of the invention is set forth in the appended claims and equivalence of the structures set forth therein.

I claim:

1. A bandana-type headwear article comprising:

a fabric body having a generally polygonal shape and having a central longitudinal axis, said fabric body having a forward edge generally perpendicular to said axis, said forward edge being adapted for wear over a wearer's forehead, and a rearward edge of said body opposite said forward edge;

first and second straps secured to said body adjacent to said forward edge, said straps being provided with interlocking snap-type connectors providing for interlocking of said first and second straps at variable displacements relative to each other whereby said headwear can adjustably be secured on the head of a wearer, said first and second straps being secured to the forward edge of said body at angle which is oblique and forwardly angled relative to said axis; wherein said first strap is provided with a series of equally spaced apertures and said second strap is provided with protrusions having spacing equal to that of said apertures and adapted to be releasably locked in said apertures, said rearward edge of said body being adapted to be constrained by an elastic band behind the head of a wearer.

2. Headwear according to claim 1 wherein said fabric body is pentagonal in shape and a rearward portion thereof has three corners adapted to be gathered together behind a wearer's head.

3. A bandana-type headwear article comprising:

a fabric body having a central longitudinal axis, said fabric body having a forward edge perpendicular to said axis, said forward edge being adapted for wear over a wearer's forehead, and a rearward edge of said body opposite said forward edge, said fabric body being of a generally polygonal shape;

first and second straps secured to said body adjacent to said forward edge at an angle which is oblique and forwardly angled relative to said axis, said straps being provided with snap-type interlocking means for attachment of said first and second straps at variable displacements relative to each other whereby said headwear can adjustably be secured on the head of a wearer;

rearward surfaces defined by the rearward edge of said body being adapted to be constrained by an elastic band behind the head of a wearer.

* * * * *